US005845846A

United States Patent [19]

Watanabe et al.

[11] Patent Number: 5,845,846

[45] Date of Patent: Dec. 8, 1998

[54] SPRAYING NOZZLE AND METHOD FOR EJECTING LIQUID AS FINE PARTICLES

[75] Inventors: Osami Watanabe, Itano-gun; Katsushi Kawashima; Koji Nagao, both of Naruto; Hiroyuki Mori, Anan, all of Japan

[73] Assignee: Fujisaki Electric Co., Ltd., Anan, Japan

[21] Appl. No.: 692,477

[22] Filed: Aug. 6, 1996

[51] Int. Cl.[6] ..... B05B 7/12; B05B 1/26

[52] U.S. Cl. ..... 239/8; 239/403; 239/424; 239/543

[58] Field of Search ..... 239/543, 433, 239/438, 423, 424, 416.5, 417.3, 416.4, 432, 568, 597, 549, 400, 403, 404, 405, 406, 8, 10

[56] References Cited

U.S. PATENT DOCUMENTS

| | | | |
|---|---|---|---|
| 3,335,956 | 8/1967 | James | 239/568 X |
| 3,642,202 | 2/1972 | Angelo | 239/424 X |
| 3,980,233 | 9/1976 | Simmons et al. | 239/424 X |
| 4,221,339 | 9/1980 | Yoshikawa | 239/424 X |
| 4,504,014 | 3/1985 | Leuning | 239/433 |
| 4,682,991 | 7/1987 | Grethe et al. | 3/26 |
| 4,790,485 | 12/1988 | Yamamoto | 239/568 X |
| 4,801,086 | 1/1989 | Noakes | 239/549 X |
| 5,427,317 | 6/1995 | Huttlin | 239/424 X |
| 5,447,567 | 9/1995 | Tanaka et al. | 239/424 X |

FOREIGN PATENT DOCUMENTS

| | | |
|---|---|---|
| 0458685A1 | 11/1991 | European Pat. Off. . |
| 44-46 | 1/1969 | Japan . |
| 45-41522 | 12/1970 | Japan . |
| 58-156546 | 10/1983 | Japan . |
| 2-107363 | 4/1990 | Japan . |
| 52-108610 | 8/1997 | Japan . |
| 1298121 | 11/1972 | United Kingdom . |

*Primary Examiner*—Kevin Weldon

*Attorney, Agent, or Firm*—Wenderoth, Lind & Ponack, L.L.P.

[57] ABSTRACT

The spraying nozzle of this invention establishes supersonic gas jets directed towards an edge on two liquid flow surfaces formed by that edge. High frequency aerodynamic oscillations are generated in front of the edge. Liquid is supplied to the liquid flow surfaces. The gas flow spreads liquid on a liquid flow surface into a thin film which flows along the liquid flow surface towards the edge. The thin film flow becomes thinner, separates from the edge, and is sprayed as liquid droplets. The liquid droplets are sucked into the gas jet convergence point where they are further fragmented into extremely fine particles by shock waves of the gas jets. The ultra-fine particles are rapidly swept away from the edge by the gas flow.

20 Claims, 16 Drawing Sheets

SPRAYING NOZZLE AND METHOD FOR EJECTING LIQUID AS FINE PARTICLES

BACKGROUND OF THE INVENTION

The present invention relates to a spraying nozzle and a method for ejecting liquid as fine particles, and in particular, to a method for ejecting liquid as extremely minute particles and to a nozzle which principally uses compressed air as a high pressure gas to spray liquid.

The nozzles shown in FIGS. 1 and 2 have been developed for spraying liquid as fine particles. The spraying nozzle shown in FIG. 1 produces a first stage of liquid droplets 2 by supplying liquid to the cylindrical air passage 1 where it mixes with air in the mixing chamber 1' disposed at the end of the air passage 1 and is ejected from the tip of the nozzle. The jets of first stage liquid droplets 2 mutually converge and collide to form still finer particles of a second stage of liquid droplets 3. This particular spraying nozzle configuration can eject water as 10 $\mu$m fine particles at a spraying rate of 1 kg/min with air-to-liquid ratio of 2300 NI/kg.

The spraying nozzle shown in FIG. 2 is a double tube arrangement which ejects center-orifice from the center orifice 4 and pressurized air from the region surrounding the liquid. In this spraying nozzle configuration, liquid ejected at the center is disturbed by the surrounding air to form small droplets. This disturbance by the surrounding air flow proceeds inwardly towards the center of the liquid but as it does, the speed of the air gradually decreases resulting in larger droplets of the liquid. Namely, droplets surrounding the liquid ejected into the center region interfere with its ability to mix with air, and poor mixing results in larger droplets.

The spraying nozzles shown in FIGS. 1 and 2 have the characteristic that fine droplets can be formed from a liquid sprayed with pressurized air. However, although the spraying nozzle shown in FIG. 1 can be used with a liquid such as pure water which does not include solid constituents, it cannot be used with liquids which include solid constituents such as spray-dry liquids. This is because when droplets dry within the mixing chamber 1', solid constituents dissolved in the liquid form a sludge which progressively accumulates on chamber walls, and within only several minutes of operation this accumulated sludge clogs the mixing chamber 1'. Even if this sludge build-up on the chamber walls is extremely small, it will disturb the high speed air flow enough to prevent the production of fine liquid droplets. Specifically, liquids which include solid constituents cannot be sprayed unless a nozzle structure is realized which avoids build-ups at all locations on the end of the spraying nozzle.

The spraying nozzle shown in FIG. 1 is a so-called internal mixing type which mixes air and liquid within the spraying nozzle. This nozzle is limited to ejecting only liquids which do not form solids when dried and has the drawback that it cannot spray fine particles of diverse liquids.

The spraying nozzle shown in FIG. 2 is an external mixing type which mixes air and liquid outside the spraying nozzle. Nozzle clogging as described above does not occur in this type of spraying nozzle. However, for this spraying nozzle, it is necessary to make the center orifice 4 extremely small and eject liquid in a very narrow stream to produce fine particles. Consequently, since the center orifice 4 of this configuration of spraying nozzle must be small, the amount of liquid sprayed per unit time is extremely small. For particle diameters of 10 $\mu$m or less, the center orifice of this spraying nozzle has an inside diameter of 0.2 mm with an air-to-liquid ratio of 2000 NI/kg. The spraying rate in this case does not even exceed 15 g/min. Attempts to increase the size of the center orifice and obtain fine particles result in very large air-to-Liquid ratios from 10000 to 100000 NI/kg. This drastically increases the amount of pressurized air used and is impractical to implement.

The internal mixing scheme of prior art technology resulted from efforts to obtain fine particles by improving air-liquid mixing and dispersion in two-fluid-phase spraying nozzles. A two-fluid-phase spraying nozzle is one in which liquid-phase fluid is converted to fine particles by the action of gas-phase high pressure air. However, spraying liquids such as spray-dry liquids which contain solid components with an internal mixing type nozzle causes internal solidification and nozzle clogging. Consequently, it is necessary to use an external mixing type nozzle to spray liquids, such as spray-dry liquids which contain components which become solids when dried.

The air-to-liquid ratio of an external mixing type spraying nozzle must be extremely large to obtain fine particles. Specifically, this type of spraying nozzle has the drawback that large quantities of pressurized air are consumed. Furthermore, the spraying nozzle diameter cannot be made large. Since a nozzle capable of spraying large quantities of liquid is not available, several hundred to several thousand spraying nozzles must be combined together to assemble a usable spraying apparatus. This is presently not practical.

Both spraying nozzles shown in FIGS. 1 and 2 spray ejected liquid droplets in a full-cone pattern, not in a hollow-cone pattern. Hollow-cone is a type of spray pattern which is annular or ring-shaped. Contrary to this, full-cone is a conical shape of ejected droplets with an interior completely filled with liquid droplets. In general, hollow-cone is better for spray-dry applications. This is because complete filling of the full-cone pattern with liquid droplets prevents droplets at the center from drying rapidly.

The present invention was developed to solve these and other drawbacks of prior art technology. It is thus a primary object of the present invention to provide a spraying nozzle and method for ejecting liquid as fine particles which continually ensures a large spray quantity using a single nozzle, which can spray liquid as extremely fine particles of uniform size distribution using a small quantity of gas or small gas-to-liquid ratio, and at the same time which can spray even liquids that include solid components continuously over long periods without accumulating sludge.

It is another primary object of the present invention to provide a spraying nozzle and method for ejecting liquid as fine particles wherein a plurality of liquids can be mixed in a single spraying nozzle.

It is still another primary object of the present invention to provide a spraying nozzle and method for ejecting liquid as fine particles wherein it is also possible to eject the liquid in a hollow-cone pattern when necessary.

The above and further objects and features of the invention will more fully be apparent from the following detailed description with accompanying drawings.

SUMMARY OF THE INVENTION

The present invention succeeded in overcoming prior art deficiencies by spraying liquid according to the following method. The superior ability of the ejection method and nozzle of this invention to make very fine particles is shown with several embodiments. In this invention, supersonic gas flows are established and directed towards an edge along two liquid flow surfaces that form that edge. In general, the supersonic gas flows are air streams, but depending on the application, gases such as nitrogen may also be used. A collision point is created in the region at the tip of the edge where the supersonic gas jets converge. An intense shock wave is generated at this gas jet convergence point. A slit is provided along a liquid flow surface such that its extension would intersect with a gas jet. When liquid issues out from the slit, the gas flow forces it against the liquid flow surface while spreading it out into a thin film. In this state, the liquid flows along the liquid flow surface towards the edge. Its flow rate increases making the liquid still thinner, and this flowing thin film separates from the edge forming liquid droplets. The liquid droplets are sucked into the convergence point of colliding gas jets and the shock wave at the gas jet convergence point induces further break-up to form extremely minute liquid droplets. These extremely minute liquid droplets ride the combined flow of gas jets from both sides of the edge to quickly fly away from the nozzle.

The spraying nozzle of the present invention can have a plurality of slits established on a liquid flow surface and can supply liquid to liquid flow surfaces on both sides of the edge. Liquids supplied to the liquid flow surfaces from a plurality of slits are mixed together on the liquid flow surfaces when they are formed into a thin film. When the thin film separates from the edge, it collides with a flowing thin film from the liquid flow surface on the opposite side of the edge to mix with it and form liquid droplets. This location where flowing thin films collide is called the liquid convergence point. Liquid droplets formed at the liquid convergence point are sucked by the gas flow into the gas jet convergence point where they are further mixed and broken-up due to the shock wave producing extremely minute liquid droplets.

In short, the ejection method of the present invention uses supersonic gas flow to spread liquid thinly on a liquid flow surface forming a flowing thin film. The flowing thin film is broken-up by a shock wave at the gas jet convergence point. By this method, it is possible to make fine particles with uniform particle size distributions which are not attainable using prior art methods.

FIG. 3 shows liquid being sprayed from a nozzle which supplies liquid from a plurality of slits to liquid flow surfaces disposed on both sides of an edge. In the spraying nozzle of FIG. 3, liquid is spread out thinly into a thin film on a liquid flow surface 37 in a thin film formation zone 324. The liquid spread into a thin film becomes liquid droplets in a liquid droplet formation zone off the front of the edge 37A, and is further broken-up into fine particles in a fine particle formation zone. The liquid droplet formation zone is the liquid convergence point 325 and the fine particle formation zone is the gas jet convergence point 326. Considering liquid mixing, thin film mixing occurs at a first mixing zone which is at the liquid flow surface 37 thin film formation zone 324. Liquid flow collision mixing occurs at a second mixing zone which is the liquid convergence point 325. Finally, vibrational mixing occurs at a third mixing zone which is the gas jet convergence point 326. In this manner, the liquid is mixed at the first, second, and third mixing zones for ideal mixing and spraying.

The ejecting method and nozzle of the present invention which sprays liquid as described above has exceptional characteristics that could not be realized by prior art spraying nozzles. First, the quantity of liquid ejected per unit time is large, and second, uniformly sized minute liquid droplets can be ejected. This is because the ejecting method and nozzle of this invention spreads liquid into thin films several microns thick by high speed gas flow over liquid flow surfaces, guides the flowing thin films to the gas jet convergence point, and breaks-up the liquid into fine particles due to high frequency aerodynamic oscillations generated at the gas jet convergence point. In addition, since the edge that liquid sprays from can be made long in a ring shape, a spiral shape, or a linear arrangement, this system has the characteristic that large quantities of liquid can be sprayed as fine particles from a single nozzle with a small gas-to-liquid ratio.

Further, the spraying nozzle and method for ejecting liquid as fine particles of this invention can continuously eject even liquids containing solid components over long periods without accumulating solids on the nozzle. This is because the ejecting method and nozzle of this invention sprays liquid while the flowing thin films self clean the liquid flow surfaces and the edge. Still further, the ejecting method and spraying nozzle of this invention can eject fine particles in all spray patterns including straight, full-cone, hollow-cone, and horizontal radial patterns by varying the arrangements of edge shape and ejection direction.

DETAILED DESCRIPTION OF THE INVENTION

A spraying nozzle is provided with liquid flow surfaces on both sides of an edge for liquid to flow as thin film streams. The liquid flow surfaces have liquid outlets at intermediate locations for ejecting liquid in a sheath-like flow pattern. The liquid outlets are formed in slit shapes of a specified width. The angle that a liquid outlet makes with respect to a liquid flow surface $\gamma$ is an obtuse angle. Liquid outlets are provided on liquid flow surfaces on both sides of the edge or on a liquid flow surface on only one side of the edge. The liquid flow surfaces promote spreading of the liquid into thin film flows by providing a curvature in regions near the edge or warping of planar surfaces near the edge. Pressurized gas is ejected from gas ejection orifices onto the liquid flow surfaces. Gas flows along the liquid flow surfaces towards the edge at supersonic speeds. The liquid flow surfaces are smooth surfaces in the direction of liquid flow. The gas ejection orifices open in directions aimed at the liquid outlets along the liquid flow surfaces.

Among the spraying nozzles of the present invention, a nozzle with a ring-shaped edge is provided with a gas flow attachment cavity which can prevent liquid droplets from adhering to the nozzle. The gas flow attachment cavity causes gas to swirl around while flowing along the surface of the end plane of the spraying nozzle. This layer of gas flow prevents fine liquid droplets from adhering to the end of the nozzle.

Figure 6:
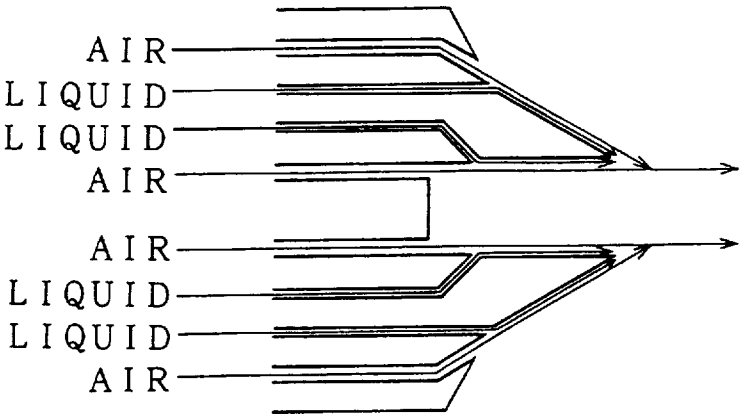
FIG. 6 is a diagram showing a 0° ejection angle nozzle having liquid flow surfaces and an annular edge.
Figure 7:
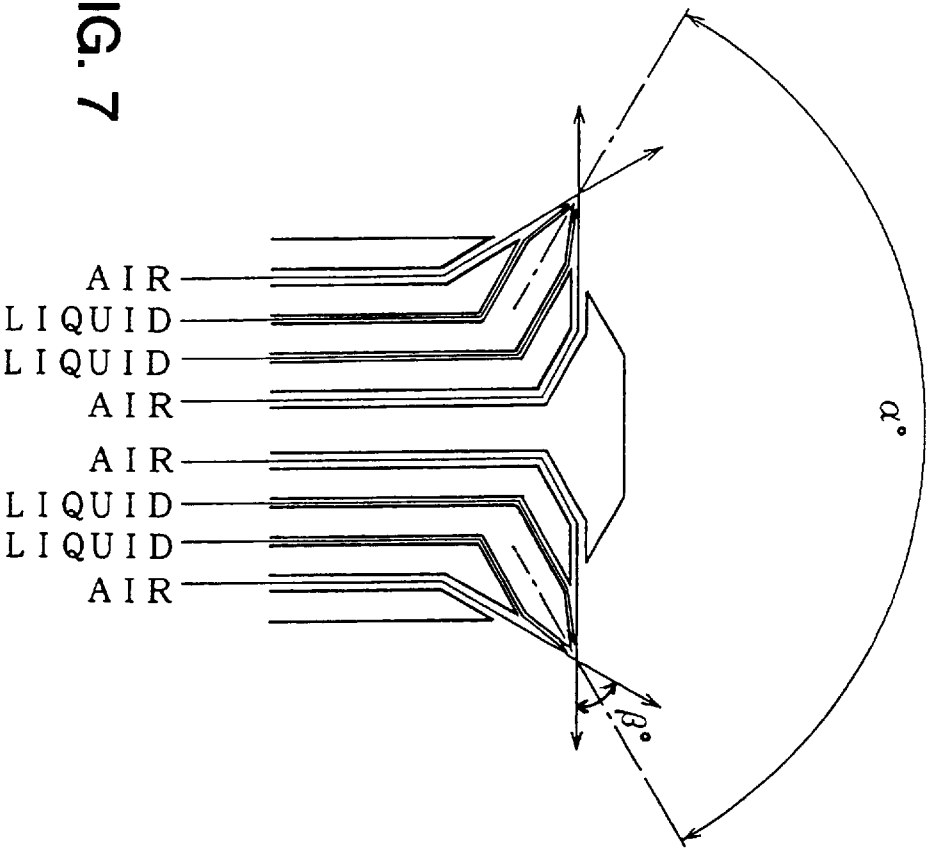
FIG. 7 is a diagram showing an $\alpha$° ejection angle nozzle having liquid flow surfaces and an annular edge.
Figure 8:
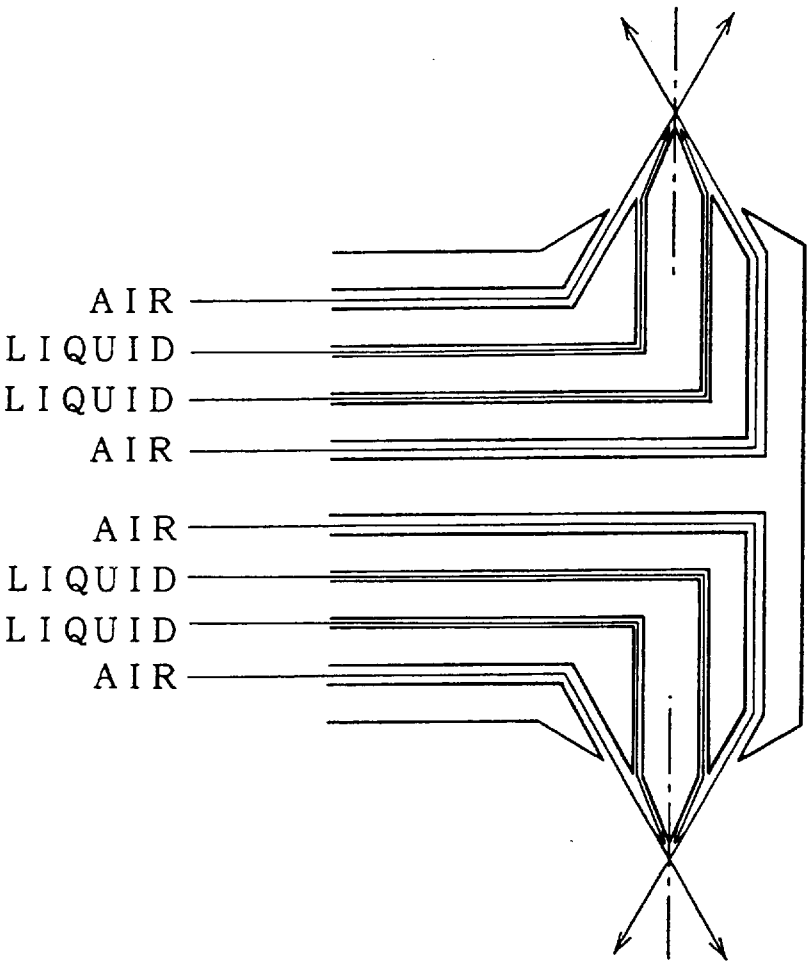
FIG. 8 is a diagram showing a 180° ejection angle nozzle having liquid flow surfaces and an annular edge.

Further, the ejection angle of the liquid sprayed from the nozzle can be adjusted by the direction which the ring-shaped edge is aimed. The ejection angle $\alpha$ is the angle at which liquid is ejected from the spraying nozzle to form fine particles. FIG. 6 shows a spraying nozzle with inside liquid flow surfaces of the straight type. The edge of this nozzle is directed inward, and the spray pattern of this nozzle is of the straight type. The edge direction and ejection angle of the spraying nozzle shown in FIG. 7 are the same. If the ejection angle $\alpha$ of this nozzle is decreased, the spray pattern will become full-cone, and if the ejection angle $\alpha$ is increased it will become hollow-cone. The spraying nozzle of FIG. 8 has an ejection angle $\alpha$ of 180° and the spray pattern is not conical but rather is horizontal and radially outward. In the manner described here, the spraying pattern of the nozzle of this invention can be designed without restraint to fit the application objective.

The following describes in detail spraying nozzle embodiments of the present invention based on the drawings.

Figure 1:
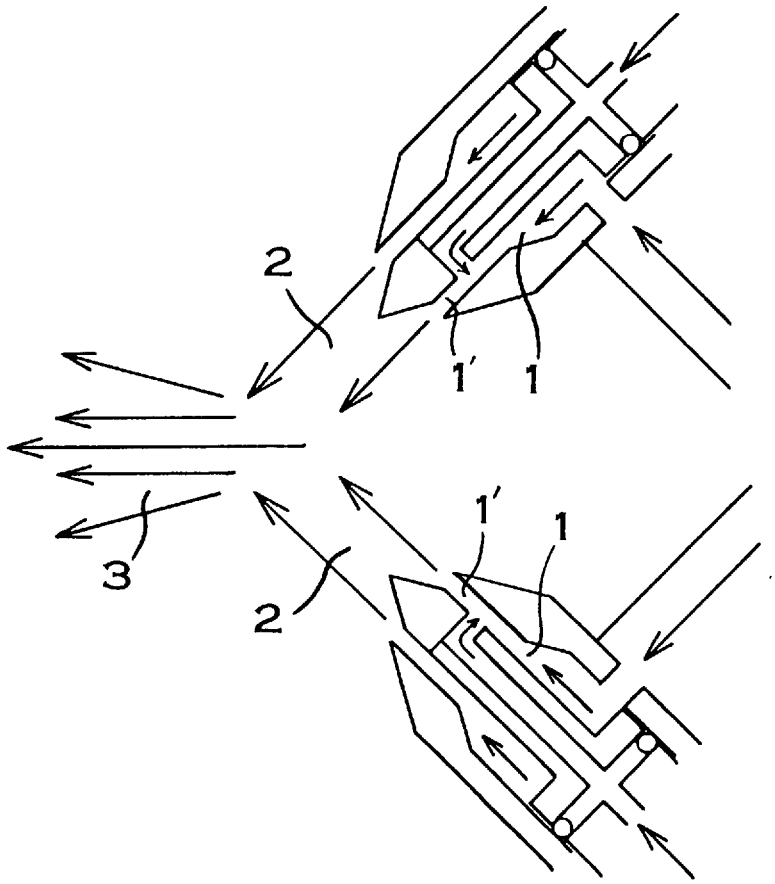
FIG. 1 is across-sectional view of a prior art spraying nozzle for ejecting liquid as fine particles.
Figure 2:
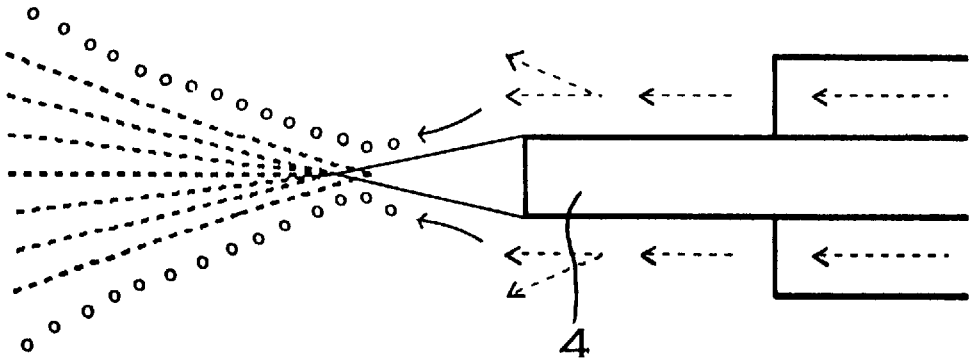
FIG. 2 is a diagrammatic cross-sectional view of another embodiment of a prior art spraying nozzle for ejecting liquid as fine particles.
Figure 3:
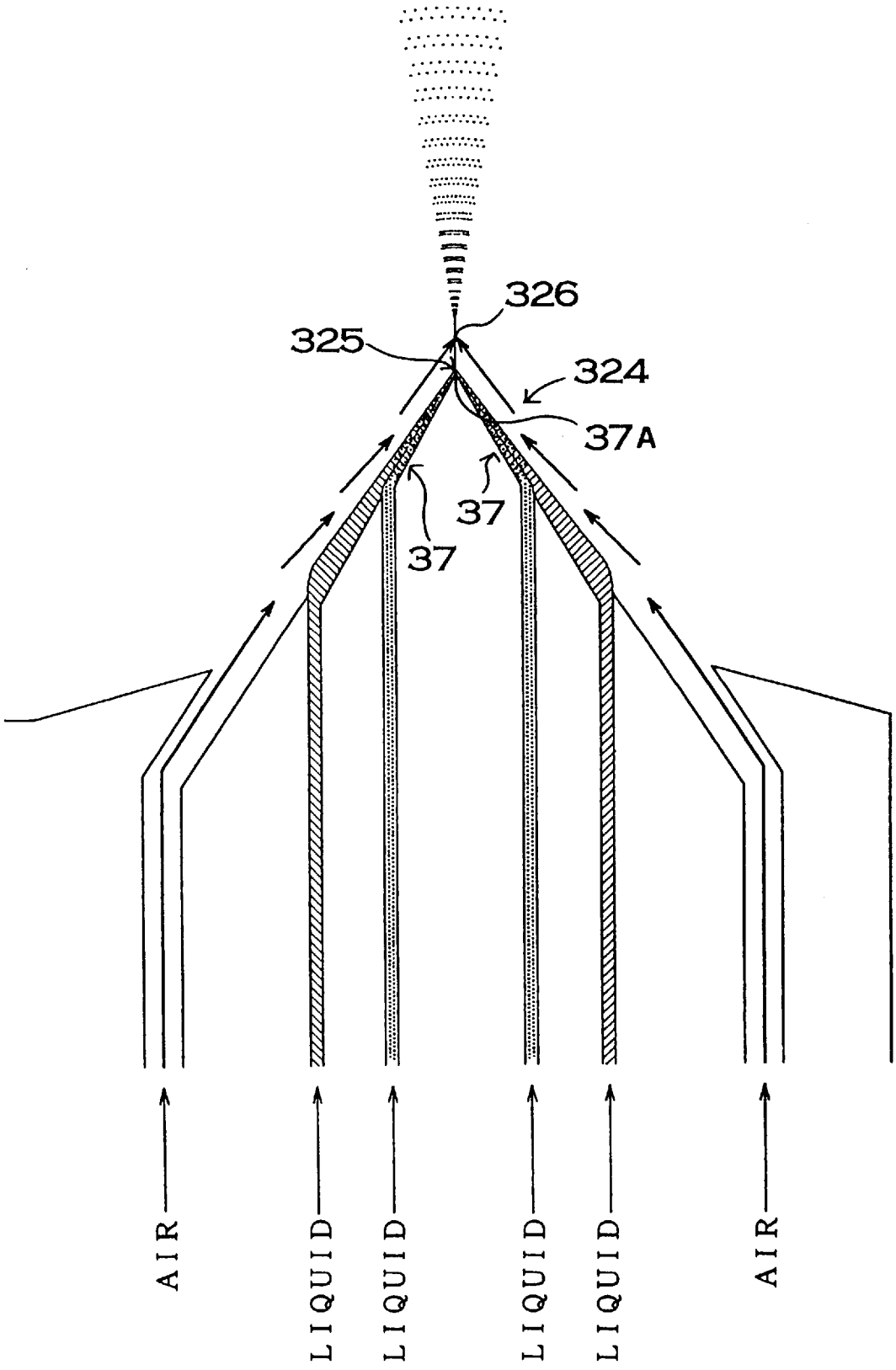
FIG. 3 is a cross-sectional view of a spraying nozzle embodiment of the present invention showing liquid being ejected as fine particles.
Figure 4:
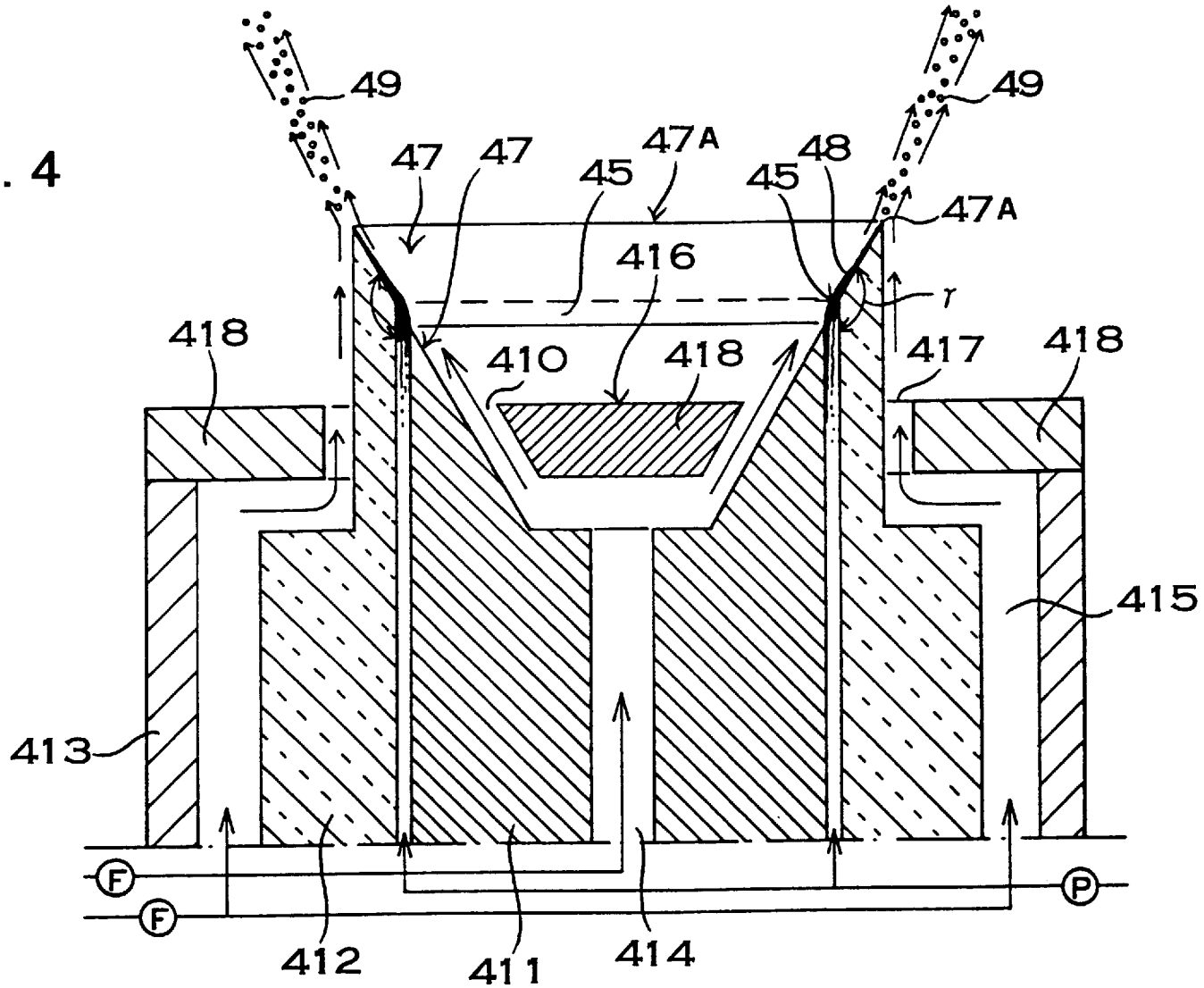
FIG. 4 is a cross-sectional view of an embodiment of the spraying nozzle for ejecting liquid as fine particles of the present invention.

Turning to FIG. 4, the spraying nozzle for ejecting liquid as fine particles shown is provided with a liquid outlet 45 which ejects liquid in a annular pattern, an liquid flow surface 47 which causes liquid ejected from the liquid outlet 45 to flow, and a gas ejection orifice 410 which ejects pressurized gas at this liquid flow surface 47.

The spraying nozzle shown in FIG. 4 is provided with an inside ring 411, a middle ring 412, and an outside ring 413. The liquid outlet 45 is disposed between the inside ring 411 and the middle ring 412, an inside atomizing gas passage 414 is disposed at the center of the inside ring 411, and an outside atomizing gas passage 415 is disposed between the middle ring 412 and the outside ring 413.

The shape of the inside ring 411 is cylindrical, and the inside surface of the middle ring 412 is also formed in a cylindrical shape. The liquid outlet 45 is an annular slit of prescribed width established between the inside ring 411 and the middle ring 412. The slit shaped liquid outlet 45 is designed to have a width that will not disturb the flow of gas along the liquid flow surface. Therefore, the slit width of the liquid outlet 45 is designed to an optimum value depending on the amount of liquid flow delivered, the length of the liquid flow surface 47, the speed of the inside atomizing gas flow on the liquid flow surface 47, the inside diameter of the liquid outlet 45, and other factors. For example, the liquid outlet 45 slit width is designed to be 0.1 mm to 1.5 mm, preferably 0.1 mm to 1 mm, and optimally approximately 0.25 mm.

The diameter of the annular liquid outlet 45 slit is designed to an optimum value depending on the amount of liquid flow ejected, the slit width, and other factors. For example, in a spraying nozzle which ejects 1000 g/min of liquid, the diameter of the liquid outlet 45 slit is approximately 50 mm. The diameter of the liquid outlet 45 slit is made larger for larger quantities of liquid flow and smaller for smaller quantities of liquid flow.

The end planes of the inside ring 411 and the middle ring 412 are processed to form a tapered shape which becomes the liquid flow surface 47. The liquid flow surface 47 on the inside ring 411 and the middle ring 412 is formed as a single plane to avoid disruption of gas flow along the liquid flow surface 47 of the inside ring 411 at the discontinuity between the inside ring 411 and the middle ring 412. When the liquid flow surface 47 of both the inside ring 411 and the middle ring 412 form a single plane, there is no step along the liquid flow surface 47 over both rings. This means that gas flows in a linear fashion from the liquid flow surface 47 of the inside ring 411 to the liquid flow surface 47 of the middle ring 412. To fabricate this type of single plane taper on the liquid flow surface 47 of both the inside ring 411 and the middle ring 412, the taper process can be performed after joining the inside ring 411 and the middle ring 412. The liquid flow surface 47 of the spraying nozzle shown in FIG. 4 is made in a conical shape with an overall smooth surface.

By establishing the liquid flow surface 47 on both the inside ring 411 and the middle ring 412, the liquid outlet 45 opens to an intermediate point along the liquid flow surface 47. The angle of inclination $\gamma$ of the liquid flow surface 47, established on the inside ring 411 and the middle ring 412, is designed to make the angle of the liquid outlet 45 with respect to the liquid flow surface 47 an obtuse angle.

A center ring 416 is disposed at the end of the inside ring 411 and the gas ejection orifice 410 and opens between this center ring 416 and the inside ring 411. Although not shown in the figure, the center ring 416 is fixed in a prescribed position on the inside ring 411. The outside surface of the center ring 416 is tapered to follow the liquid flow surface 47 of the inside ring 411. The gas ejection orifice 410, formed between the center ring 416 and the inside ring 411, is also slit shaped and annular. Pressurized gas is ejected from this gas ejection orifice 410 in a laminar fashion inducing a high speed gas flow along the liquid flow surface 47.

The gas passage 414 through the inside ring 411 is connected to a source of pressurized gas F. The gas ejection orifice 410 ejects inside atomizing gas which flows along the liquid flow surface 47. The source of pressurized gas F supplies gas to the gas ejection orifice 410 which is, for example, 1 kgf/cm$^2$ to 200 kgf/cm$^2$, and preferably 3 kg/cm$^2$ to 20 kg/cm$^2$. If the gas pressure of the inside atomizing gas is increased, not only does the speed of the gas flow along the liquid flow surface 47 increase to more effectively spread the liquid into a thin film, but the liquid droplets 49 can be made even smaller. However, a special compressor is required for increasing gas pressure above a certain level and energy consumption also increases. Therefore, an optimum gas pressure is determined based on the liquid droplet size needed and energy consumption. In general, a gas pressure around 6 kgf/cm$^2$ is often used.

In addition to inside atomizing gas provided in the spraying nozzle shown in FIG. 4, outside atomizing gas is also ejected at the periphery of the liquid flow surface 47. Both gas streams collide at the gas jet convergence point at the tip of the edge 47A inducing high frequency aerodynamic oscillations. The high frequency aerodynamic oscillations break-up the liquid thin film to increase the effect of fine particle production.

Outside atomizing gas is ejected from an outside atomizing gas ejection orifice 417 established between the middle ring 412 and the outside ring 413. The end plane of the middle ring 412 is the liquid flow surface 47, the outer periphery of the end of the middle ring 412 is cylindrical in shape, and the edge 47A is established at the tip of the liquid flow surface 47. In this middle ring 412 structure, the edge 47A is formed at the tip of the liquid flow surface 47 and has an acute angle of 180°—the inclination angle $\gamma$. However, although not shown in this figure, the periphery of the middle ring may also be tapered to adjust the edge angle $\beta$.

The spraying nozzle shown in FIG. 4 ejects liquid as fine droplets according to the following.

(1) Compressed inside atomizing gas is supplied from the gas passage 414 disposed at the center of the inside ring 411, outside atomizing gas is supplied from the outside atomizing gas ejection orifice 417 between the middle ring 412 and the outside ring 413, and liquid is delivered to the liquid flow surface 47 from the liquid outlet 45.

(2) Liquid supplied to the liquid flow surface 47 is spread into a flowing thin film 48 by the high speed flow of inside atomizing gas along the liquid flow surface 47. For example, liquid is delivered from the liquid outlet 45 with inside atomizing gas flowing at Mach 1.5 along the liquid flow surface 47. If the leading edge region of the flowing thin film 48 attains a speed 1/20th the speed of the inside atomizing gas, its speed will be 25.5 m/sec. If the diameter of the circular edge 47A formed at the tip of the liquid flow surface 47 is 50 mm and 1 l/min of liquid is supplied, the thickness of the flowing thin film 48 becomes 4 $\mu$m.

(3) When the 4 $\mu$m thick flowing film passes over the edge 47A of the liquid flow surface 47, it becomes liquid droplets which are sucked into the gas jet convergence point, divided and broken-up into fine particle liquid droplets 49. The inside atomizing gas jet and the outside atomizing gas jet collide at the gas jet convergence point inducing high frequency aerodynamic oscillations. These aerodynamic oscillations form the thin film and liquid droplets into still finer particles.

(4) The fine liquid droplets 49 are quickly carried away and dispersed from the gas jet convergence point by the inside atomizing gas jet and the outside atomizing gas jet thereby avoiding recombination.

Figure 5:
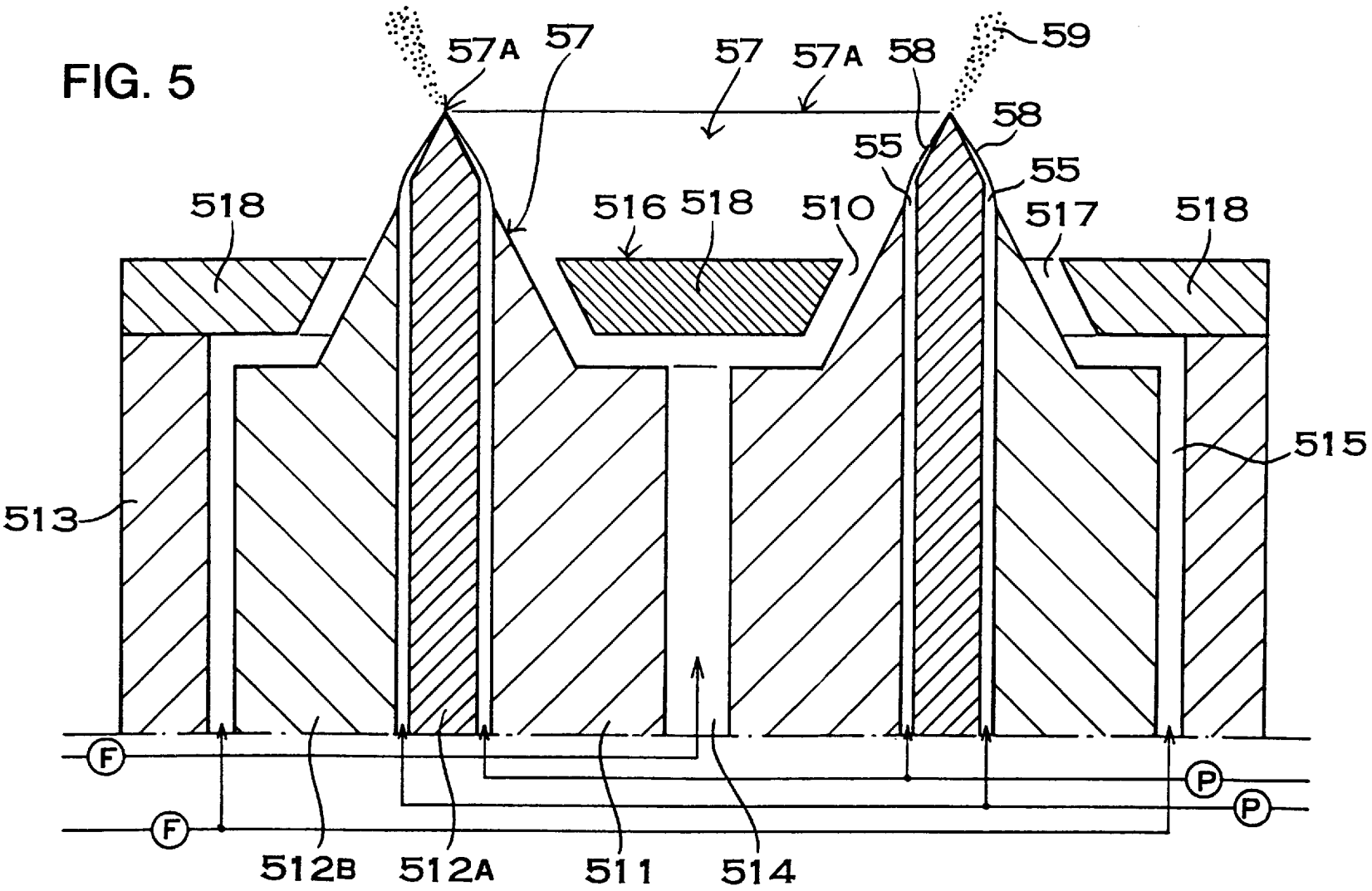
FIG. 5 is a cross-sectional view of another embodiment of the spraying nozzle for ejecting liquid as fine particles of the present invention.

Turning to FIG. 5, a spraying nozzle which mixes liquid A and liquid B to form fine particles is shown. The spraying nozzle shown in FIG. 5 has a double conduit structure in which the middle ring 412 of the spraying nozzle shown in FIG. 4 is divided into an inner middle ring 512A and an outer middle ring 512B. A liquid outlet 55 is established between the inner middle ring 512A and the outer middle ring 512B. The annular-shaped inner middle ring 512A has inside and outside surfaces that taper to form liquid flow surfaces 57 which converge at an acute angled edge 57A. The outer middle ring 512B end plane is also tapered to form a liquid flow surface 57. The liquid flow surface 57 of the outer middle ring 512B joins one of the liquid flow surfaces 57 of the inner middle ring 512A as a single continuous plane.

The spraying nozzle shown in FIG. 5 has liquid flow surfaces 57 provided on both the inside and outside surfaces of the inner middle ring 512A. A liquid A outlet 55 is established on the inside liquid flow surface 57 and a liquid B outlet 55 is established on the outside liquid flow surface 57. Further, an inside atomizing gas ejection orifice 510 is provided in the inside ring 511, and an outside atomizing gas ejection orifice 517 is provided between the outer middle ring 512B and the outside ring 513.

This spray nozzle configuration can eject liquid while uniformly mixing and dispersing liquid A and liquid B. The two different liquids supplied to the two liquid flow surfaces reach the edge as a thin film, are carried to the liquid convergence point, and are mixed as the liquid streams collide. This mixture is further carried to the gas jet convergence point where it is mixed by vibration forming fine liquid droplets. Consequently, this spraying nozzle can completely mix two liquids and spray them as fine particles. Further, since this spraying nozzle supplies liquid to liquid flow surfaces on both sides of the edge, it can spray twice the liquid quantity of the nozzle shown in FIG. 4 and reduce the gas-to-liquid ratio by half. In addition, since the self cleaning effect of the edge is near perfect, high quality particles are obtained.

Figure 9:
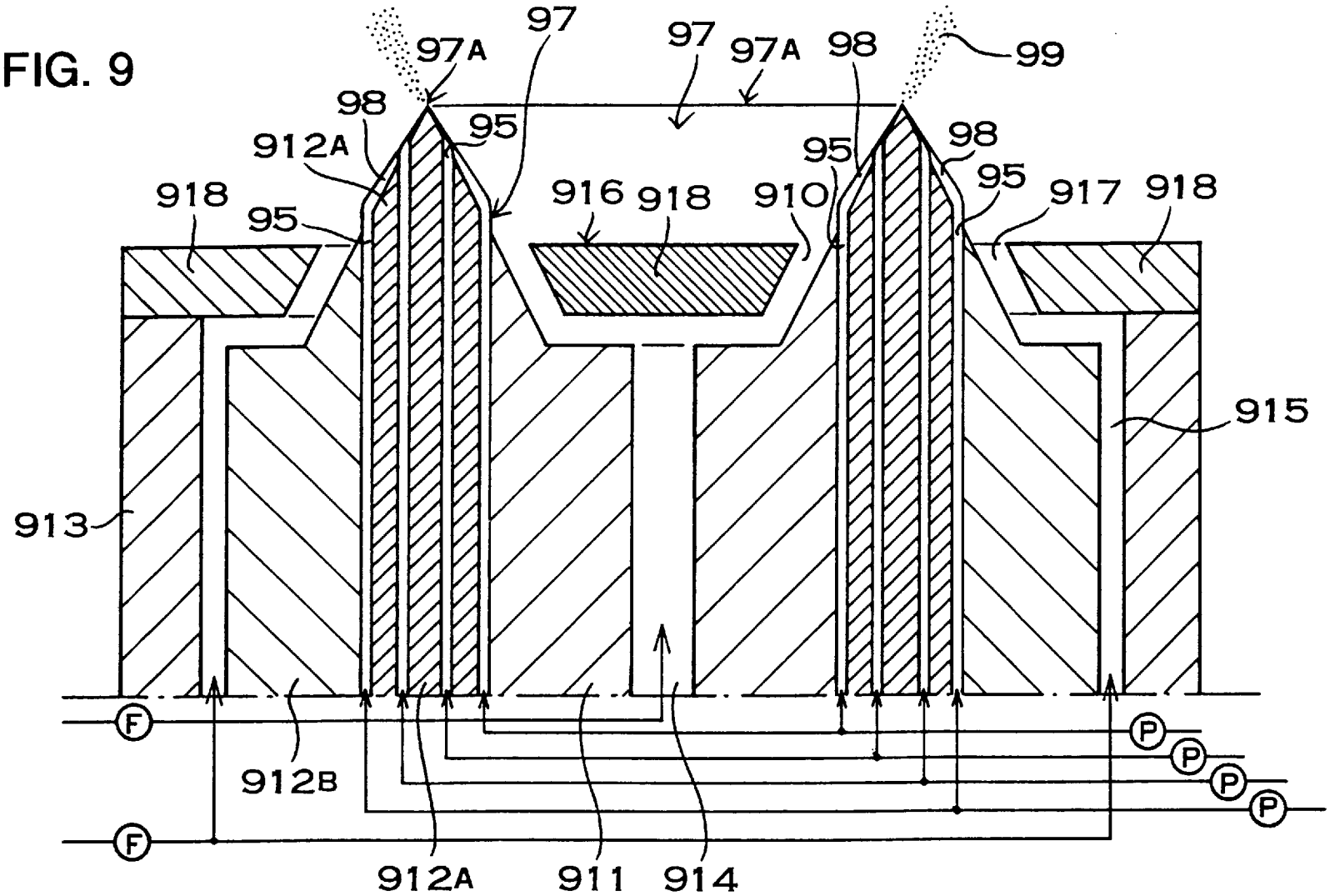
FIG. 9 is a cross-sectional view of still another embodiment of the spraying nozzle of the present invention having liquid flow surfaces and an edge for ejecting liquid as fine particles.

Turning to FIG. 9, the spraying nozzle shown is provided with a plurality of liquid outlets 95 along the liquid flow surfaces 97. With this configuration of spraying nozzle, different liquids can be supplied through the plurality of liquid outlets 95 and sprayed simultaneously. The liquids supplied to the liquid flow surfaces flow to the tip of the edge while mixing as thin films. They form fine liquid droplets and are sprayed while mixing at the liquid convergence point and the gas jet convergence point.

Figure 10:
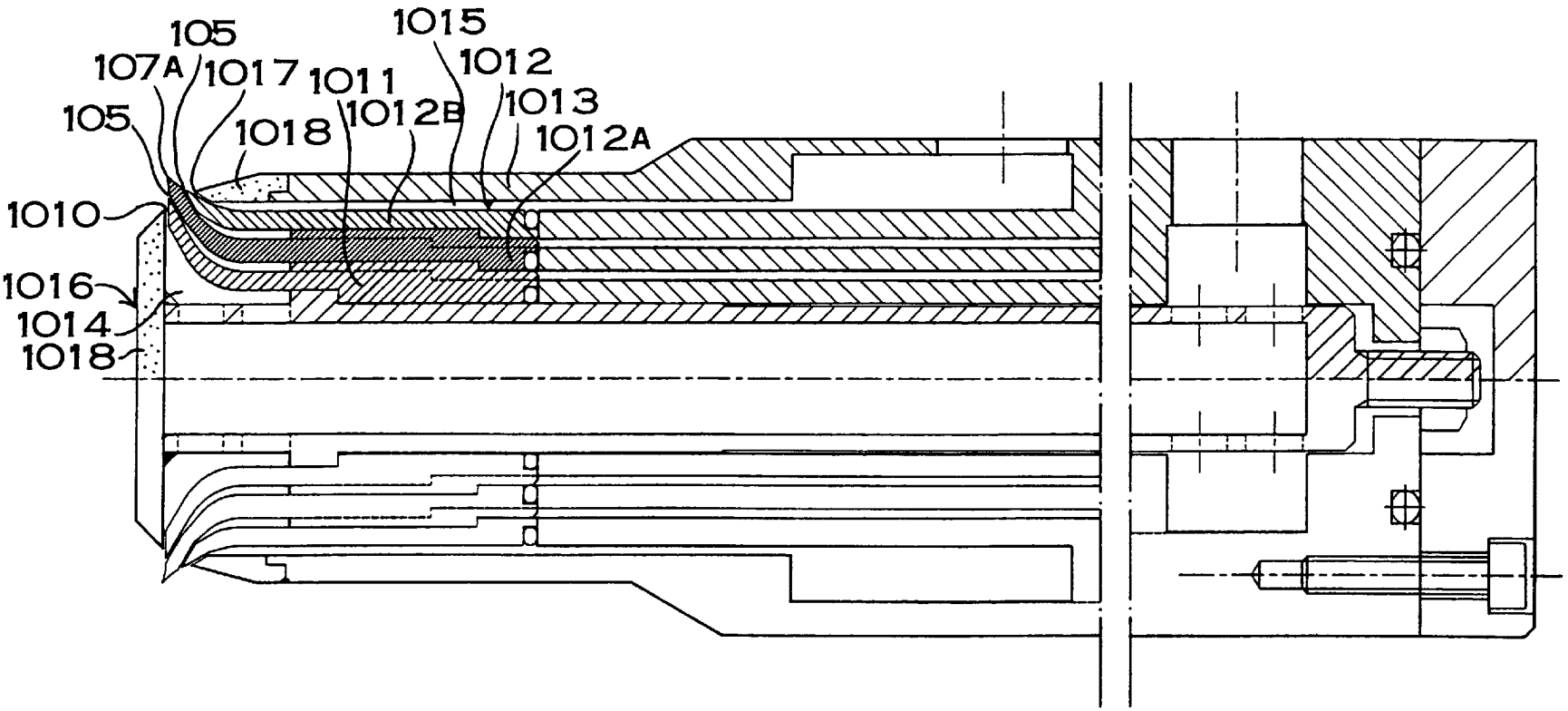
FIG. 10 is a cross-sectional view of still another embodiment of the spraying nozzle of the present invention having liquid flow surfaces and an edge for ejecting liquid as fine particles.
Figure 11:
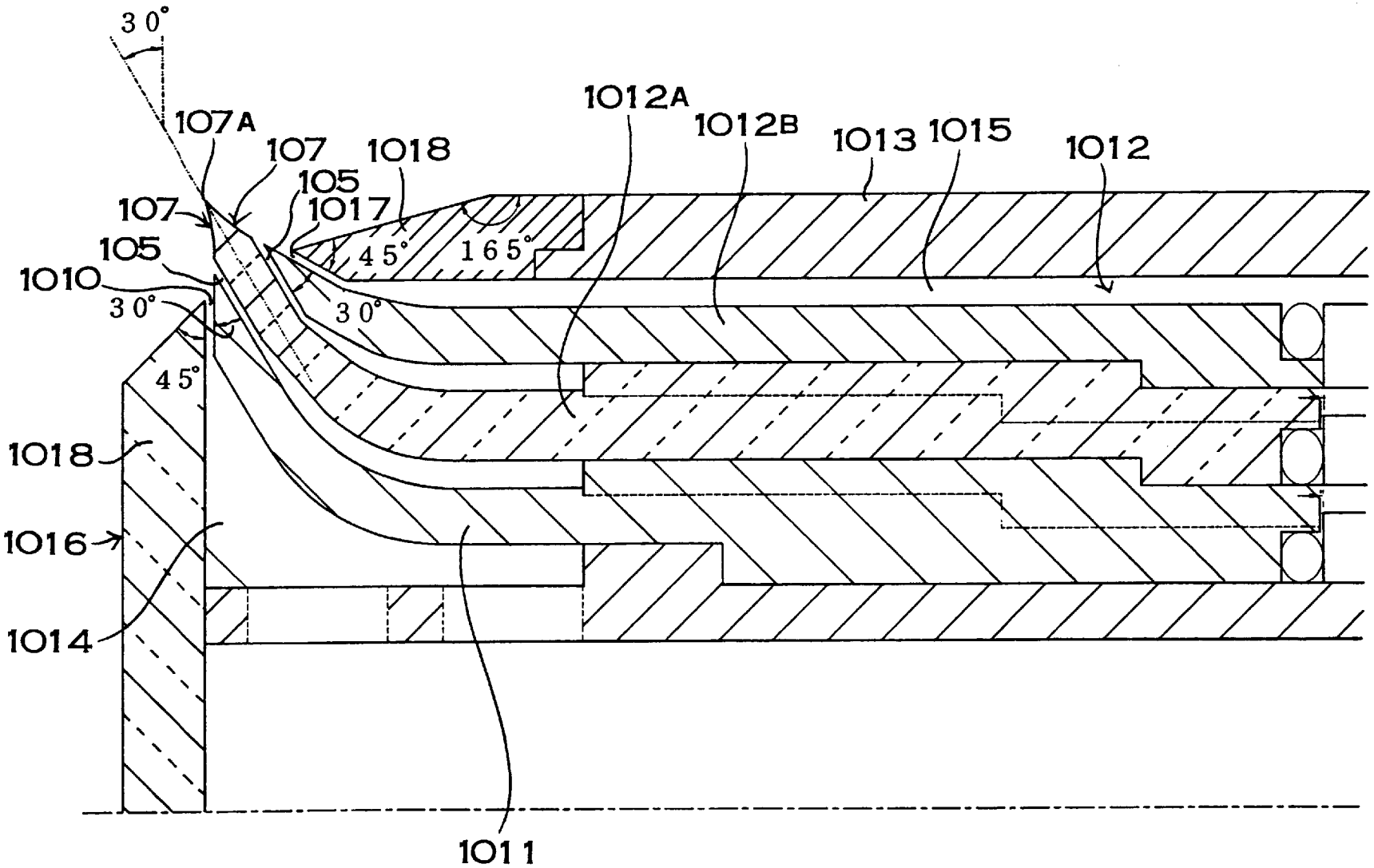
FIG. 11 is an enlarged cross-sectional view of important parts of the spraying nozzle shown in FIG. 10.

Turning to FIGS. 10 and 11, a spraying nozzle capable of spraying even finer particles is shown. The spraying nozzles shown in these and other figures have a double conduit structure similar to the spraying nozzle shown in FIG. 5. The middle ring 1012 is divided into a inner middle ring 1012A and an outer middle ring 1012B. A liquid outlet 105 is established between the inner middle ring 1012A and the outer middle ring 1012B. The inner middle ring 1012A has inside and outside surfaces that taper to form liquid flow surfaces 107 which converge at an acute angled edge 107A. The outer middle ring 1012B end plane is also tapered to form a liquid flow surface 107.

Figure 12:
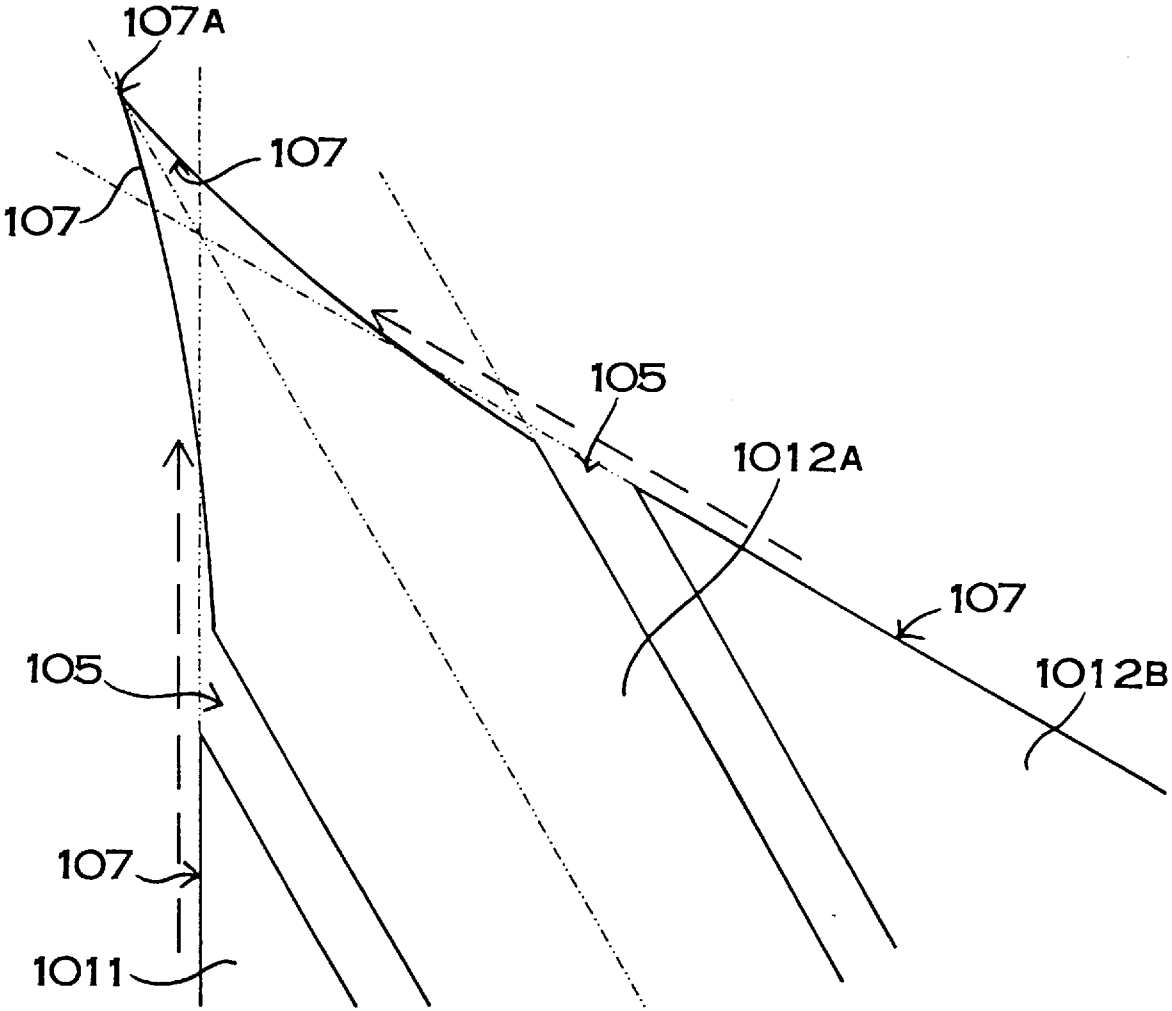
FIG. 12 is an enlarged cross-sectional view of the tip region of the inner middle ring of the spraying nozzle shown in FIG. 11.

FIG. 12 shows an enlarged view of the liquid flow surfaces. As shown in FIG. 12, in the region of the liquid outlets 105, the inner middle ring 1012A liquid flow surfaces 107 are designed lower so as to form a slight step with respect to straight line extensions from the outer middle ring 1012B and inside ring 1011 liquid flow surfaces 107 positioned on either side. As indicated by the arrows in the figure, a nozzle with this type of liquid flow surfaces has the characteristic that high speed gas flow along the liquid flow surfaces 107 can smoothly discharge liquid from the liquid outlets 105. This is because the inner middle ring 1012A liquid flow surfaces 107 do not protrude out from the liquid flow surfaces 107 on either side. Although not illustrated, if the inner middle ring 1012A liquid flow surfaces 107 protrude beyond straight line extensions from the liquid flow surfaces 107 on either side, gas will collide with the protrusions and liquid will not discharge smoothly.

In addition, the nozzle shown in the enlarged view of FIG. 12 is formed with curved inner middle ring 1012A liquid flow surfaces 107 causing the tip section to protrude into straight line extensions of neighboring liquid flow surfaces 107. With inner middle ring 1012A liquid flow surfaces 107 having this structure, high speed gas flow in the direction of the arrows along the liquid flow surfaces 107 is strongly thrust against the tip section of the liquid flow surfaces 107 allowing even thinner spreading of the thin film flow of liquid along the liquid flow surfaces 107. Consequently, this type of spraying nozzle has the characteristic that liquid can be ejected as extremely fine particles, for example, 1 $\mu$m to 5 $\mu$m particles.

The spraying nozzles shown in these figures can spray liquid in a hollow-cone pattern when the tip angles of the outer middle ring 1012B, the inner middle ring 1012A, and the inside ring 1011 are designed as shown in the figures.

The spraying nozzles shown in FIGS. 4, 5, 10, and 13 are constructed with gas permeable material 418, 518, 1018, and 1318 in the end regions of the center ring and outside ring which form the inside atomizing gas ejection orifice and outside atomizing gas ejection orifice. The gas permeable material has a porosity that causes gas entering the gas ejection orifices under pressure to pass through the material and be ejected from its surfaces. For example, the gas permeable material is a stainless sintered metal. The gas permeable material ejects a portion of the gas from the gas ejection orifices out its surfaces and has the effect of preventing particles from adhering to the surfaces of the end regions of the inside ring and outside ring.

Figure 13:
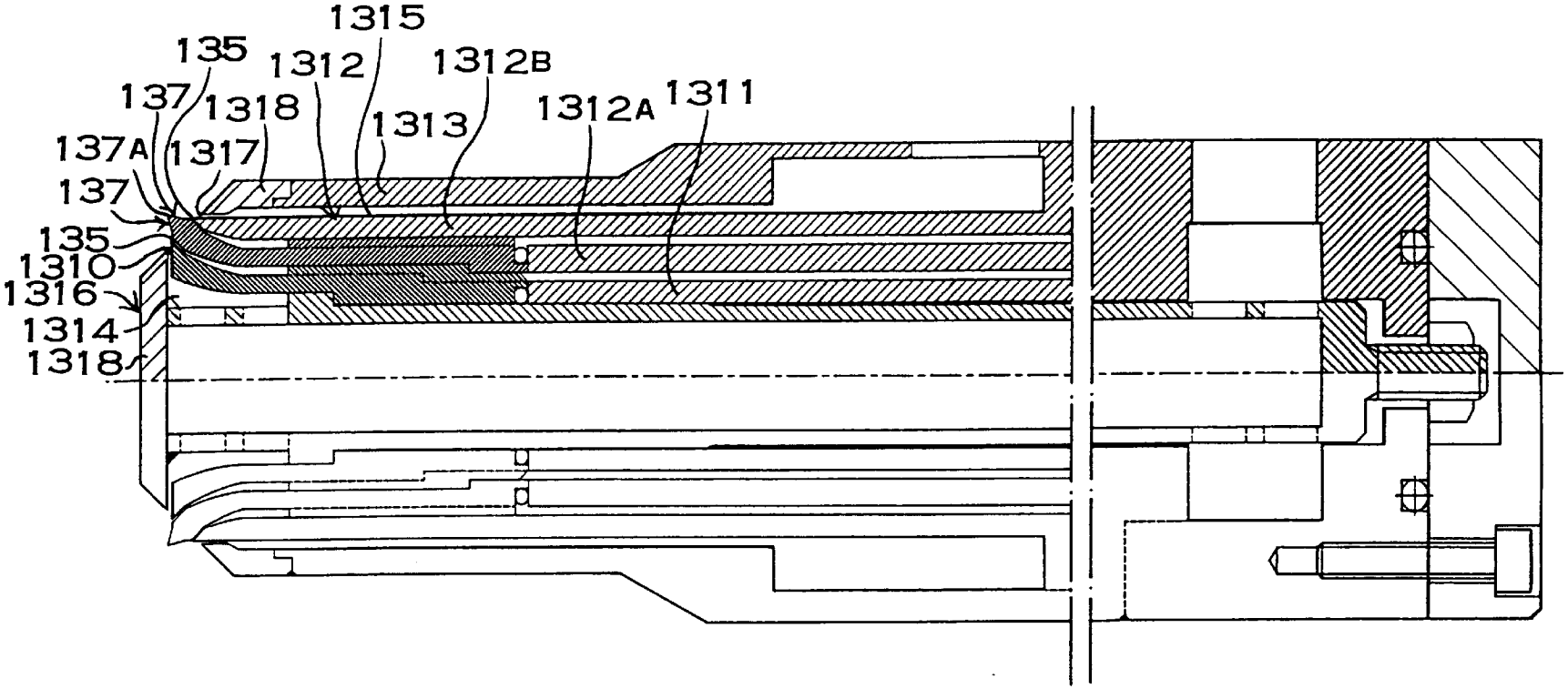
FIG. 13 is a cross-sectional view of still another embodiment of the spraying nozzle of the present invention having liquid flow surfaces and an edge for ejecting liquid as fine particles.
Figure 14:
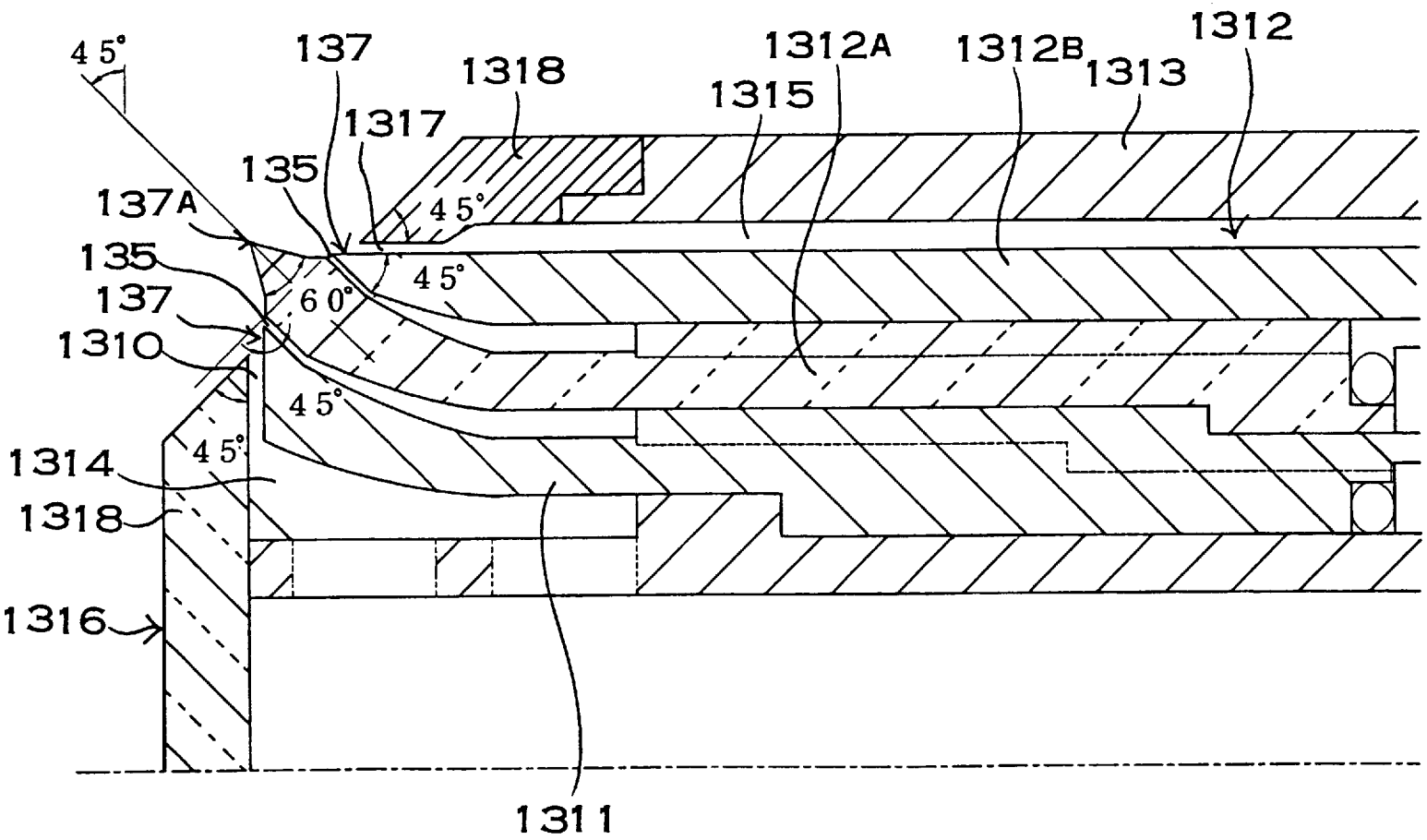
FIG. 14 is an enlarged cross-sectional view of important parts of the spraying nozzle shown in FIG. 13.

Turning to FIG. 13, a spraying nozzle which can eject fine particles in both hollow-cone and full-cone patterns is shown. FIG. 14 shows an enlarged cross-sectional view of important parts of the tip region of the nozzle shown in FIG. 13. This nozzle has a double conduit structure similar to the spraying nozzle shown in FIG. 5 wherein the middle ring 1312 is divided into a inner middle ring 1312A and an outer middle ring 1312B. Liquid outlets 135 are established between the inner middle ring 1312A and the outer middle ring 1312B. The inner middle ring 1312A has inside and outside surfaces that taper to form liquid flow surfaces 137 which converge at an acute angled edge 137A. The outer middle ring 1312B end plane has a liquid flow surface 137 which is actually straight with respect to the outer middle ring 1312B.

Figure 15:
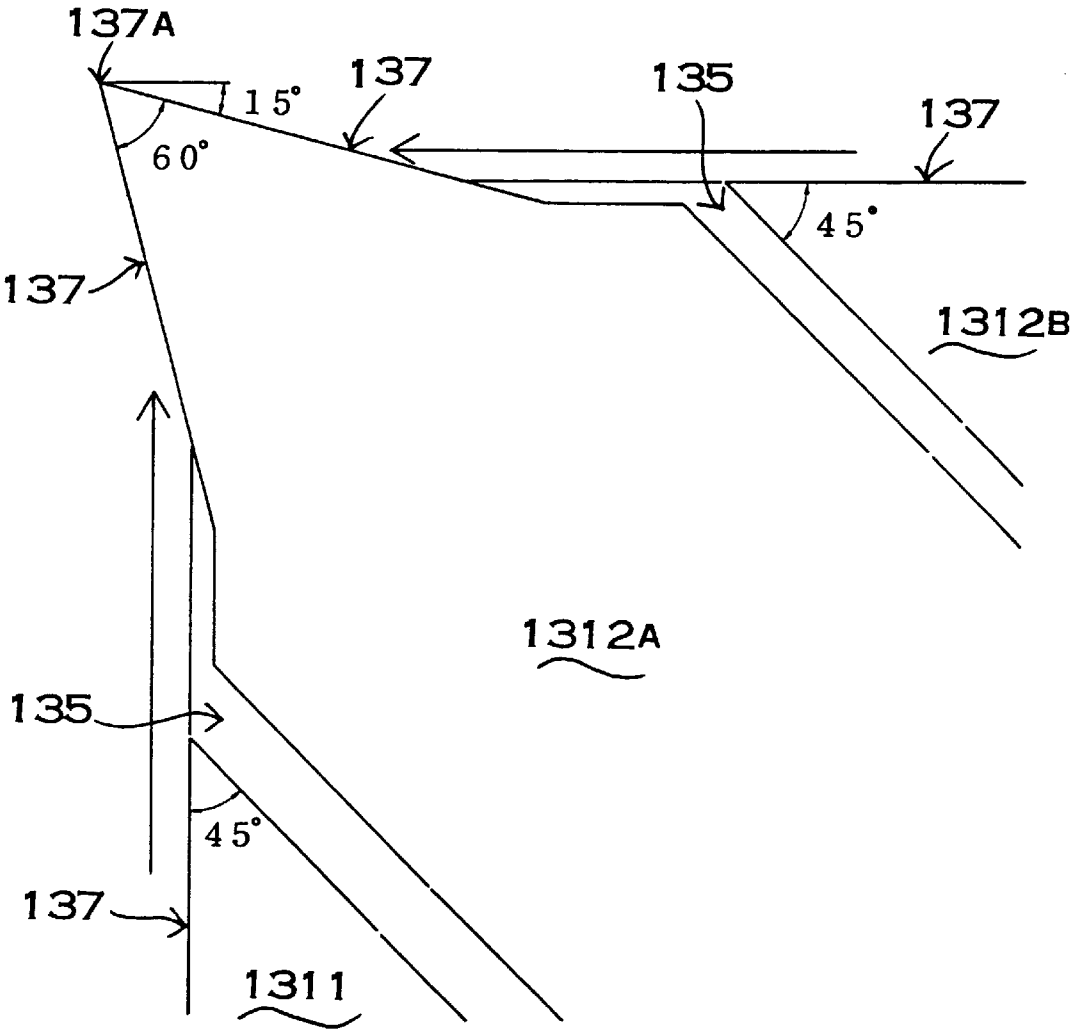
FIG. 15 is an enlarged cross-sectional view of the tip region of the inner middle ring of the spraying nozzle shown in FIG. 14.

FIG. 15 shows an enlarged view of the liquid flow surfaces 137 provided on the inner middle ring 1312A. As shown in FIG. 15, in the region of the liquid outlets 135, the inner middle ring 1312A liquid flow surfaces 137 are designed lower, as in the nozzle of FIG. 12, to form a slight step with respect to straight line extensions from the outer middle ring 1312B and inside ring 1311 liquid flow surfaces 137 positioned on either side. As indicated by the arrows in the figure, a nozzle with this type of liquid flow surfaces also has the characteristic that high speed gas flow along the liquid flow surfaces 137 can smoothly discharge liquid from the liquid outlets 135.

In addition, the nozzle shown in FIG. 15 is formed with middle ring 1312A liquid flow surfaces 137 having inclination angles that change along the surfaces warping the tip section so that it protrudes into straight line extensions of neighboring liquid flow surfaces 137. With inner middle ring 1312A liquid flow surfaces 137 bent in this configuration, high speed gas flow in the direction of the arrows along the liquid flow surfaces 137 is strongly thrust against the tip section of the liquid flow surfaces 137 allowing even thinner spreading of the thin film flow of liquid along the liquid flow surfaces 137. Consequently, this type of spraying nozzle has the characteristic that liquid can be ejected as extremely fine particles.

Further, the edge angle $\beta$ of the spraying nozzle shown in FIG. 15 is 60°, which is 30° greater than the edge angle of the spraying nozzle shown in FIG. 12. A spraying nozzle with a large edge angle $\beta$ has an intense collision at the gas jet convergence point of supersonic gas flows from liquid flow surfaces on either side of the edge. This allows liquid droplets to be more finely broken-up. However, since the speed of the converged gas jets drops more, liquid droplet dispersion is degraded and droplet recombination occurs. Consequently, an optimum angle $\beta$ is selected based on both the properties of the liquid used and the liquid flow quantity.

The spraying nozzle shown in FIG. 13 can eject liquid in both hollow-cone and full-cone patterns. To eject liquid in a hollow-cone pattern, the ejection pressure of inside atomizing gas ejected from the inside atomizing gas ejection orifice 1310 is made greater than the ejection pressure of outside atomizing gas ejected from the outside atomizing gas ejection orifice 1317. Conversely, liquid can be ejected in a full-cone pattern if the ejection pressure of outside atomizing gas ejected from the outside atomizing gas ejection orifice 1317 is made greater than the ejection pressure of inside atomizing gas ejected from the inside atomizing gas ejection orifice 1310.

Figure 16:
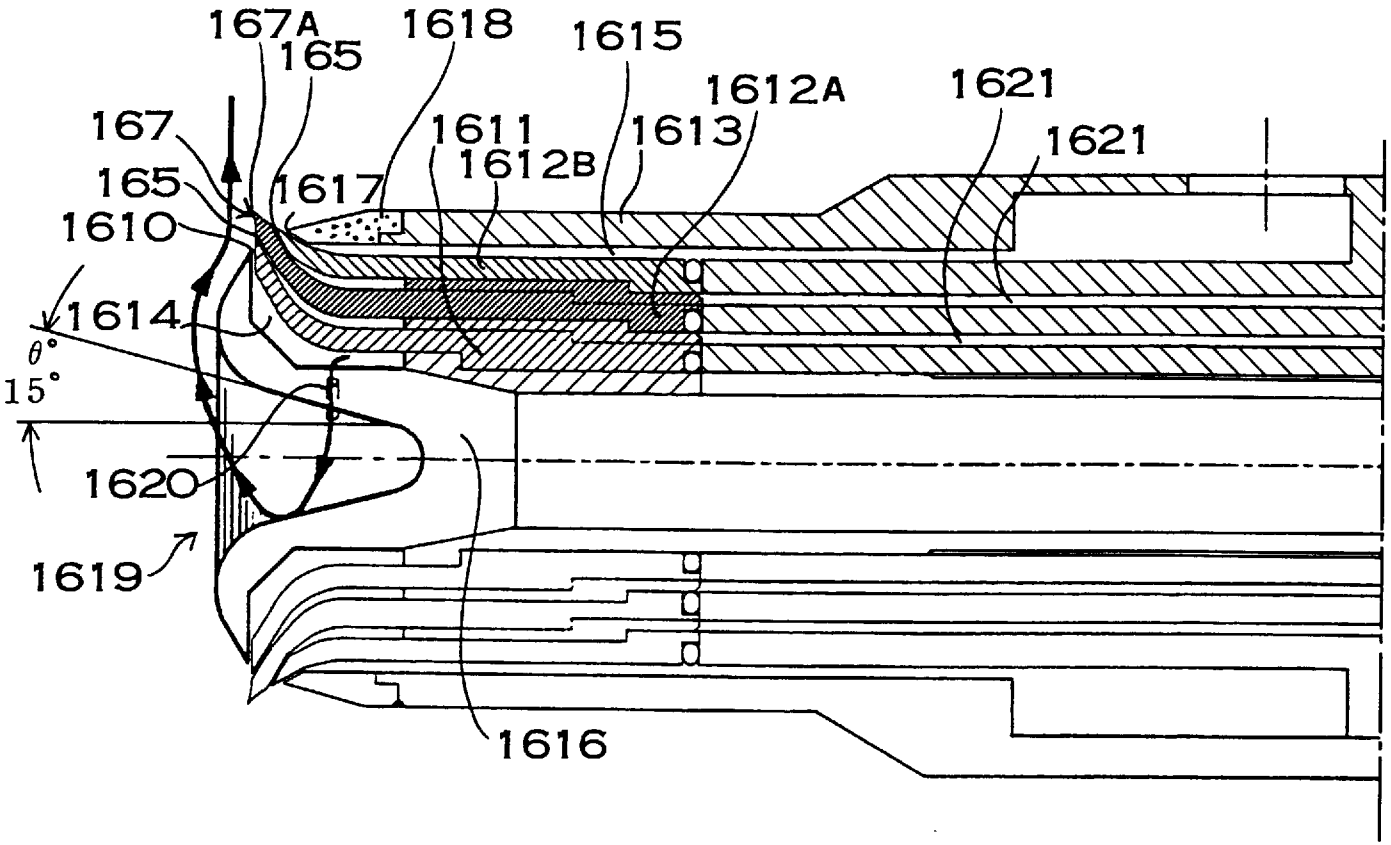
FIG. 16 is a cross-sectional view of still another embodiment of the spraying nozzle of the present invention having liquid flow surfaces and an edge for ejecting liquid as fine particles.
Figure 17:
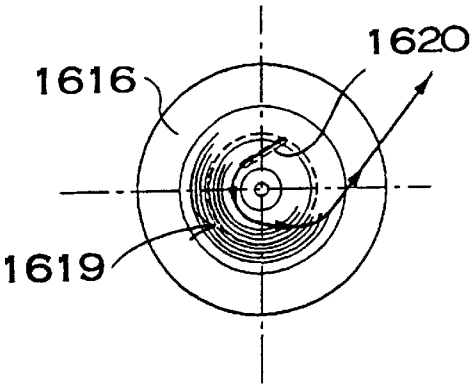
FIG. 17 is a plan view of the gas flow attachment cavity shown in FIG. 16.

Turning to FIG. 16, a spraying nozzle is shown which does not use permeable material but prevents mist or particle adhesion by a novel structure. The nozzle shown in FIG. 16 is provided with a gas flow cavity 1619 disposed in the end plane of the center ring 1616. Namely, the gas flow cavity 1619 is provided in the end plane of the spraying nozzle. The gas flow cavity 1619 connects with the inside atomizing gas passage 1614 between the inside ring 1611 and the center ring 1616 by a via hole 1620 through the center ring 1616. As shown in FIG. 17, the hole 1620 opens in a direction tangent to the inside radius of the gas flow cavity 1619. Namely, the hole 1620 opens in a direction causing ejected gas to rotate within the gas flow cavity 1619. The face of the gas flow cavity 1619 is made as a smooth surface allowing gas and particulates to slide easily thereon. Moreover, the outer edge of the gas flow cavity 1619 is streamlined in an airfoil shape so as to smoothly curve towards the gas ejection orifice 1610.

In this type of spraying nozzle, when pressurized gas is ejected from the hole 1620 into the gas flow cavity 1619 in a tangential direction, it collides with the tapered inside surface of the gas flow cavity 1619 and spreads into a thin layer while developing a circulating flow pattern. Here the percent of gas flow in the direction of the gas flow cavity 1619 outlet (upwards in FIG. 16) can be set by the angle of taper ($\theta$) of the gas flow cavity 1619. When the angle of taper ($\theta$) is 15°, as shown in FIG. 16, the fraction of circulating gas flow moving in the direction of the outlet is 70%. The remaining 30% is circulating gas flow moving in a direction towards the bottom of the gas flow cavity 1619. This gas loses speed once it reaches the bottom of the gas flow cavity 1619 and subsequently becomes mixed with the previously mentioned 70% high speed circulating gas flow which is discharged from the gas flow cavity 1619.

High speed circulating gas flow along the inner surface of the gas flow cavity 1619 climbs the tapered inside surface to the airfoil shaped streamlined section. When it reaches the edge, it flows along the airfoil shaped surface and is sucked into the inside atomizing gas stream ejected from the inside atomizing gas ejection orifice 1610. Since the airfoil shaped streamlined section curves smoothly towards the gas ejection orifice 1610, gas flows along the surface and a layer of gas is established over the end plane of the center ring 1616.

Since this layer of gas covers the entire end plane of the center ring 1616, particles do not adhere to it. To allow uniform discharge of gas from the gas flow cavity 1619, approximately six holes 1620 are desirable. The number of holes can also be much greater. Moreover, if the lateral width of the holes is increased to form slits, gas can be uniformly discharged from the gas flow cavity with fewer than five holes.

Figure 18:
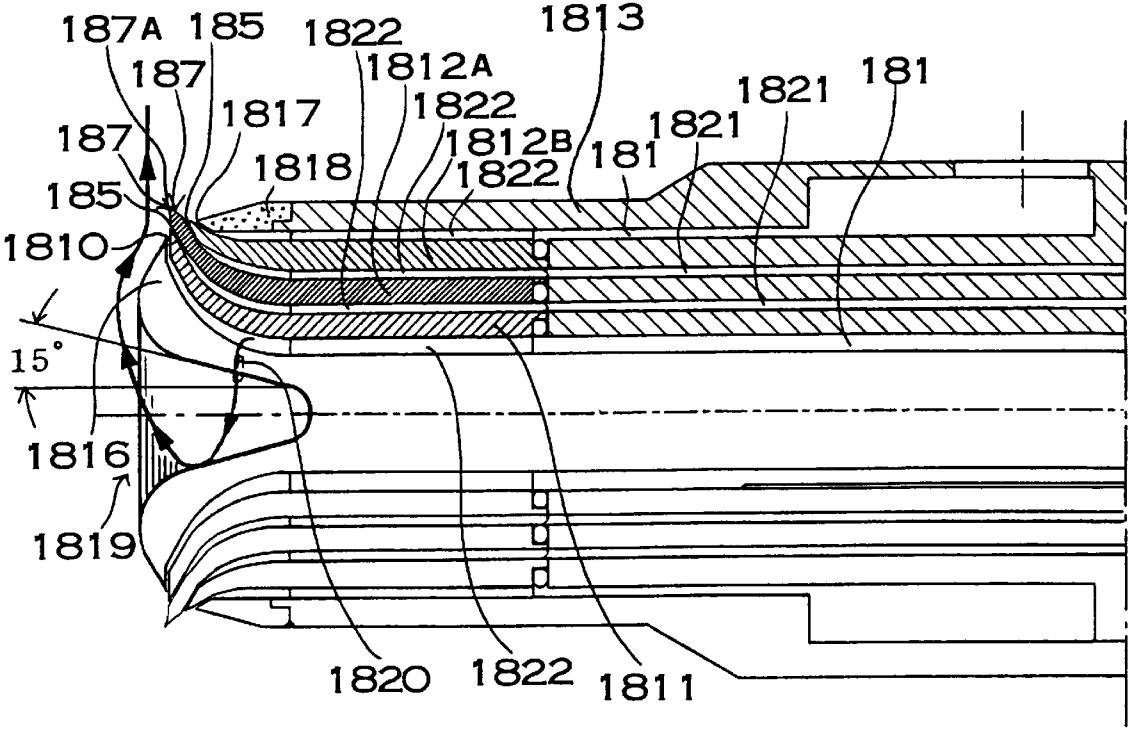
FIG. 18 is a cross-section view of still another embodiment of the spraying nozzle of the present invention having liquid flow surfaces and an edge for ejecting liquid as fine particles.
Figure 19A:
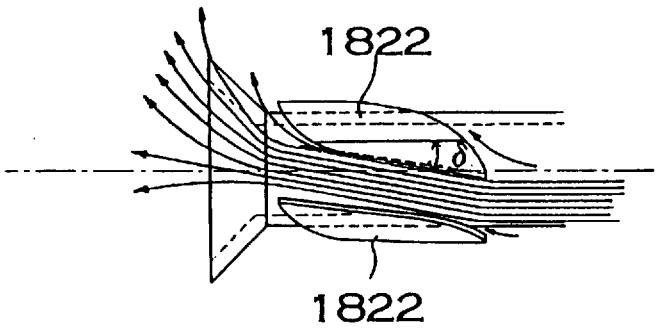
FIG. 19A is a front view and FIG. 19B is a plan view of the helical ribs provided between the rings shown in FIG. 18.
Figure 19B:
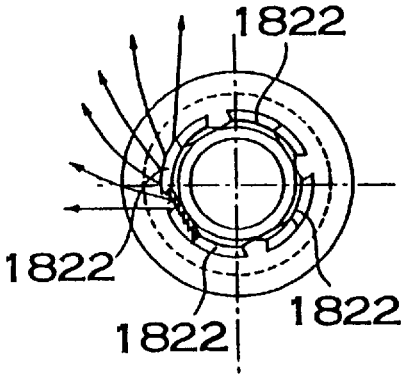

Turning to FIG. 18, a spraying nozzle is shown which reduces the gas-to-liquid ratio and more efficiently converts liquid droplets into fine particles. The nozzle of FIG. 18 has helical ribs 1822 disposed in the gas passages 181 and liquid passages 1821. As shown in FIG. 19, helical ribs are established to provide spin to the fluid flow. The direction of spin may be clockwise or counter clockwise, but the same spin direction is established for liquid and gas flowing on the same liquid flow surface. This is to prevent waves in the thin film flow on the liquid flow surface and avoid reducing spin energy or flow speed. The relative spin directions of flows on liquid flow surfaces on opposite sides of the edge are arranged to be in opposite directions. Liquid and gas flows guided to the liquid convergence point and the gas jet convergence point collide with opposing spins. This results not in a simple collision of fluid streams, but rather a collision with spin that improves the droplet break-up operation.

Ribs such as the helical ribs 1822 are also useful for proper alignment of each ring center during assembly.

Figure 20A:
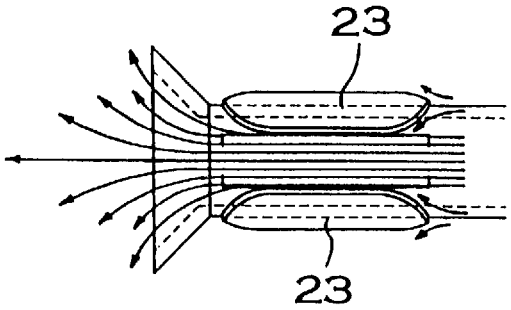
FIG. 20A is a front view and FIG. 20B is a plan view of prior art straight ribs provided between rings.
Figure 20B:
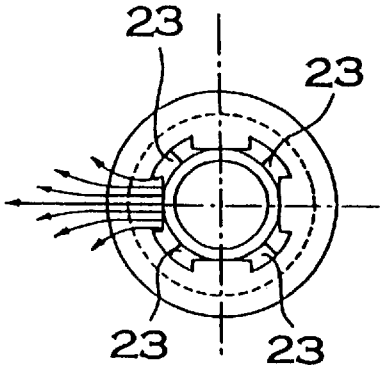

The straight ribs 23 shown in FIG. 20 leave a wake in the flow stream even when both ends are streamlined. Helical ribs can eliminate this wake. As shown in FIG. 18, when straight ribs are changed into spiral shaped helical ribs 1822, fluid which passes through those helical ribs 1822 develops spin, and fluid with spin is forced against the conduit walls by centrifugal force. As a result, the fluid spreads out along circular paths and becomes uniform. In FIG. 19, the angle of inclination δ of the helical ribs 1822 provided in a liquid passage is designed, for example, to be 60°. However, the angle of inclination δ can be in the range from 30° to 70°, and preferably in the range from 45° to 65°. The angle of inclination δ is the angle made by the center line of the helical ribs 1822 with respect to the nozzle center line.

Next, consider the angle of inclination δ of the helical ribs 1822 provided in a gas passage which is designed, for example, to be 30°. Since the flow rate of the gas is higher than that of the liquid, sufficient spin can be developed even with a smaller angle of inclination δ. The angle of inclination δ of gas passage helical ribs is designed to be from 15° to 45°, and preferably from 25° to 35°.

If the angle of inclination δ of helical ribs provided in gas and liquid passages is made large, good spin is developed but drag against the passing fluid is increased. An optimum angle of inclination δ of the helical ribs is determined considering both fluid spin and drag.

The number of helical ribs is determined by the angle of inclination δ, rib length, and passage diameter dimensions, but in general is set in the range from 3 to 12 ribs. Further, it is best to minimize rib width within the allowable strength range. Still further, it is best to cut both ends of the ribs on a slant as shown in FIG. 19 to avoid interrupting the flow.

The following experiment tested the exceptional characteristics of a spraying nozzle having supersonic gas flows with opposing spins. Initially, a nozzle with the structure shown in FIG. 18 and inner and outer gas passage and liquid passage helical ribs having opposing spin directions was set-up in a spray-dry apparatus and operated by spraying and drying. The liquid for spray-dry use was a solution of fluoro-uracil based medicinal source of metabolic inhibitor dissolved in methylene chloride. The atomizing gas and drying gas was air. Drying conditions were 20 $m^3$/min air flow rate and 65° C. supply air temperature. Spraying conditions were 5 kgf/$cm^2$ inside atomizing air pressure, 1100 NI/min air flow rate with 190 NI/min of that flow going to the gas flow attachment cavity, 800 g/min inside liquid flow rate, 5 kgf/$cm^2$ outside atomizing air pressure, 1100 NI/min air flow rate, 800 g/min outside liquid flow rate, and 1260 NI/kg air-liquid ratio sprayed for 180 min.

The particle size distribution and average particle diameter for particles obtained under these conditions were as follows.

| Particle Size Distribution [Wt %] | | | | | | | | | | | |
|---|---|---|---|---|---|---|---|---|---|---|---|
| Diameter [μm] | 14.92 | 10.55 | 7.46 | 5.27 | 3.73 | 2.63 | 1.69 | 1.01 | 0.66 | 0.43 | 0.34 |
| Wt % | 0 | 10.9 | 18.0 | 18.1 | 15.9 | 13.0 | 10.2 | 7.3 | 5.4 | 0.8 | 0 |

Average Particle Diameter = 4.01 μm

Next, a nozzle with the structure of FIG. 18 but with inner and outer helical ribs having the same spin direction was used with the same solution and drying conditions. Further, liquid flow rates and air-liquid ratio spraying conditions for obtaining the same 4 μm particles were used. Namely, 5 kgf/$cm^2$ inside atomizing air pressure, 1100 NI/min air flow rate with 190 NI/min of that flow going to the gas flow attachment cavity, 400 g/min inside liquid flow rate, 5 kgf/$cm^2$outside atomizing air pressure, 1100 NI/min air flow rate, 450 g/min outside liquid flow rate, and 2360 NI/kg air-liquid ratio sprayed for 180 min.

The particle size distribution and average particle diameter for particles obtained under these conditions were as follows.

| Particle Size Distribution [Wt %] | | | | | | | | | | | |
|---|---|---|---|---|---|---|---|---|---|---|---|
| Diameter [μm] | 14.92 | 10.55 | 7.46 | 5.27 | 3.73 | 2.63 | 1.69 | 1.01 | 0.66 | 0.43 | 0.34 |
| Wt % | 3.3 | 10.6 | 17.9 | 16.0 | 13.3 | 12.4 | 11.2 | 7.8 | 5.7 | 1.2 | 0 |

Average Particle Diameter = 4.15 μm

Comparing the results of the experiment above, a spraying nozzle with inner and outer helical ribs having the same spin direction produced particles with an average diameter of 4.15 μm using an air-to-liquid ratio of 2360 NI/kg. Even these characteristics are exceptional and show clear superiority over prior art spraying nozzles. Moreover, a spraying nozzle with helical ribs having opposing spin directions imparting opposite spins to the supersonic gas streams produced particles with an average diameter of 4.01 μm using an air-to-liquid ratio of 1260 NI/kg. Specifically, the nozzle with supersonic gas streams having opposing spins at the edge produced particles of roughly the same diameter with approximately half the air-to-liquid ratio of the nozzle with supersonic gas streams having no opposing spin. This is because the action of spin on gas and liquid inside and outside the edge at the nozzle tip produces liquid droplets which are more minute.

Further, even though the spraying nozzle of FIG. 18 was used inside the spray-dry apparatus with an ambient including many floating particles, regardless of the helical rib spin direction, due to the effect of the gas flow attachment cavity, no particle adhesion to the tip of the nozzle was observed. In addition, disassembly of the nozzle showed no accumulation of solids inside the nozzle or in the edge region of the nozzle confirming the possibility for continuous spraying for long periods.

The above embodiment is an example of use of the spraying nozzle of the present invention for spray-dry applications. However, the spraying nozzle of the present invention can be used for other applications in all fields where there is demand for ejection of liquid as uniform fine particles. For example, the spraying nozzle of this invention can be used for spraying objects without wetting them, for such purposes as soot-less liquid combustion, moisture adjustment, moisture addition, cooling, static electricity prevention, and electric charge prevention. Other applications include requirements for exceedingly fine mists and cases where different liquids are mixed and sprayed.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims or equivalence of such metes and bounds thereof are therefore intended to be embraced by the claims.

What is claimed is:

1. A method for ejecting liquid as fine particles, the method comprising:

supplying a first liquid from a liquid outlet which is disposed in a first flow surface;

supplying a first high speed flow of gas along said first flow surface such that said liquid is spread into a thin film flow and is transported by said high speed gas in a direction toward an edge of said first flow surface; and supplying a second high speed flow of gas along a second flow surface of said spray nozzle in a direction toward an edge of said second flow surface, wherein said first and second flow surfaces are formed on opposing sides of an acute angled edge portion which defines a boundary such that said first and second high speed flows of gas collide beyond said boundary to produce high frequency aerodynamic oscillations and said liquid is sprayed from said boundary into said colliding gas flows so that said particles are broken-up by the high frequency aerodynamic oscillations.

2. The method for ejecting liquid as fine particles as claimed in claim 1, further comprising supplying said first liquid from a second liquid outlet which is disposed in said second flow surface such that said liquid is spread into a second thin film flow and is transported by said second high speed flow of gas in a direction toward said edge of said second flow surface, wherein said first and second liquid thin film flows collide at said edge portion.

3. The method for ejecting liquid as fine particles as claimed in claim 1, further comprising supplying a second flow of liquid from a liquid outlet disposed in said second flow surface such that said second flow of liquid is spread into a second thin film flow and is transported by said second high speed flow of gas in a direction toward said edge of said second flow surface, wherein said first and second liquid thin film flows are formed of different liquids which collide and mix at said boundary so as to spray in a mixed state.

4. The method for ejecting liquid as fine particles as claimed in claim 1, further comprising supplying a second flow of liquid along said first flow surface such that said first and second flows of liquid are mixed on said first flow surface, wherein said first and second flows of liquids are formed of different liquids which are sprayed from said first flow surface in a mixed state.

5. The method for ejecting liquid as fine particles as claimed in claim 4, further comprising supplying third and fourth flows of liquid from third and fourth liquid outlets formed in said second flow surface such that said third and fourth flows of liquid are mixed and formed into a thin liquid film and transported to said edge of said second flow surface by said second high speed flow of gas and sprayed from said edge of said second flow surface in a mixed state.

6. A spray nozzle for ejecting liquid as fine particles, said spray nozzle comprising:

an acute angled edge portion defining a first flow surface and a second flow surface, wherein said first and second flow surfaces have a common edge;

a first liquid outlet formed in said first flow surface;

a first gas ejection outlet for ejecting pressurized gas in a direction substantially parallel to said first flow surface and towards said common edge so as to cause liquid, delivered to said first flow surface, to flow towards said common edge in the form of a thin film and to be sprayed therefrom; and a second gas ejection outlet for ejecting high pressurized gas in a direction along said second flow surface towards said common edge, wherein said first and second gas ejection outlets are oriented such that the pressurized gas flows ejected therefrom will collide at a point beyond said common edge.

7. The spray nozzle as claimed in claim 6, further comprising a second liquid outlet formed in said first flow surface.

8. The spray nozzle as claimed in claim 6, further comprising a second liquid outlet formed in said second flow surface.

9. The spray nozzle as claimed in claim 8, further comprising a third liquid outlet formed in said first flow surface, and a fourth liquid outlet formed in said second flow surface.

10. The spray nozzle as claimed in claim 6, further comprising a plurality of helical ribs disposed in a liquid flow passage which terminates in said first liquid outlet formed in said first flow surface.

11. The spray nozzle as claimed in claim 6, further comprising a plurality of helical ribs disposed in a first gas flow passage which terminates in said first gas ejection outlet.

12. The spray nozzle as claimed in claim 11, further comprising a plurality of ribs disposed in a second gas flow passage which terminates in said second gas ejection outlet, wherein said helical ribs are oriented so that gas ejected from said first and second gas ejection outlets will have opposite spin directions on said first and second flow surfaces, respectively.

13. A spray nozzle for spraying liquid in the form of fine particles, said spray nozzle comprising:

an inside ring having an annular end portion;

a high pressure gas passage defined by said inside ring and opening in said annular end portion;

a middle ring having an annular end portion defining an acute angled edge portion forming liquid flow surfaces on both sides of said acute angled edge portion, wherein said annular end portion of said inside ring and said annular end portion of said middle ring are substantially aligned so as to form a flow surface; and a liquid outlet defined by an outer peripheral surface of said inside ring and an inner peripheral surface of said middle ring.

14. The spray nozzle as claimed in claim 13, further comprising:

an outer ring disposed outside of said middle ring;

a gas ejection orifice for ejecting a pressurized gas in a direction towards a tip portion of said middle ring, said gas ejection orifice being defined by an outer peripheral surface of said middle ring and an inner peripheral surface of said outer ring.

15. The spray nozzle as claimed in claim 14, wherein:

said middle ring includes an inner middle ring and an outer middle ring, and a liquid outlet is defined by an outer peripheral surface of said inner middle ring and an inner peripheral surface of said outer middle ring;

said inner middle ring has inner and outer tapered end surfaces which define liquid flow surfaces, and said inner and outer tapered end surfaces intersect so as to form an acute angled edge portion; and said outer middle ring has a tapered end surface defining a liquid flow surface which is substantially aligned with said outer tapered end surface of said inner middle ring.

16. The spray nozzle as claimed in claim 13, further comprising a center ring disposed at a tip portion of said inside ring, and a gas ejection orifice defined by an outer peripheral surface of said center ring and a peripheral surface of said tip portion of said inside ring, wherein said gas ejection orifice is in direct fluid communication with said high pressure gas passage defined by said inside ring.

17. The spray nozzle as claimed in claim 16, wherein said center ring is comprised of a gas permeable material.

18. The spray nozzle as claimed in claim 16, wherein said center ring has a gas flow cavity formed in an outer surface thereof, and said gas flow cavity is connected to said gas passage formed between said inside ring and said center ring by a through hole formed in said center ring, and said through hole opens into said cavity in an angled direction so as to rotate gas injected into said gas flow cavity.

19. The spray nozzle as claimed in claim 18, wherein said surface of said gas flow cavity comprises a smooth surface so as to cause the gas flow therein to be a smooth laminar flow.

20. The spray nozzle as claimed in claim 18, wherein an outer peripheral surface of said gas flow cavity comprises a streamlined surface which curves towards said gas ejection orifice.

* * * * *